US005406868A

United States Patent [19]

Foster

[11] Patent Number: 5,406,868

[45] Date of Patent: Apr. 18, 1995

[54] OPEN END WRENCH

[75] Inventor: Kenneth L. Foster, Garland, Tex.

[73] Assignee: Stanley-Proto Industrial Tools, Div. of Mechanics Tools, New Britain, Conn.

[21] Appl. No.: 52,243

[22] Filed: Apr. 22, 1993

Related U.S. Application Data

[63] Continuation-in-part of Ser. No. 797,393, Nov. 25, 1991, abandoned.

[51] Int. Cl.[6] ..... B25B 13/08

[52] U.S. Cl. ..... 81/119; 81/186

[58] Field of Search ..... 81/119, 121.1, 186

[56] References Cited

U.S. PATENT DOCUMENTS 2,685,219 8/1954 Diebold .
3,242,775 3/1966 Hinkle .
3,908,488 9/1975 Andersen .
3,908,489 9/1975 Yamamoto et al. .
4,512,220 4/1985 Barnhill, III et al. .
4,581,957 4/1986 Dossier .
4,765,211 8/1988 Colvin .
4,930,378 6/1990 Colvin .
5,239,899 8/1993 Baker ..... 81/186

*Primary Examiner*—D. S. Meislin
*Attorney, Agent, or Firm*—Jones & Askew

[57] ABSTRACT

An open-end wrench is disclosed which can be used with a variety of fastener head shapes and which reduces marring or rounding-off of the corners of the fastener head. The wrench has a wrench cavity for receiving the fastener. The wrench cavity includes offset convex drive surfaces which have a radius of curvature equal to half of the fastener head width. Clearance surfaces are provided adjacent to and in continuously curving contact with the drive surfaces to accept the corners of the fastener head when force is applied to turn the fastener.

12 Claims, 2 Drawing Sheets

OPEN END WRENCH

This application is a continuation-in-part of application Ser. No. 07/797,393, filed on Nov. 25, 1991, now abandoned, in the name of Kenneth L. Foster for "Improved Open End Wrench."

TECHNICAL FIELD

The present invention relates generally to wrenches and more particularly to an improved open end wrench that applies force to the flats of a fastener head instead of the comers of the fastener head.

BACKGROUND OF THE INVENTION

Wrenches for turning fasteners such as nuts and bolts are available in a variety of configurations, including fixed jaws, adjustable jaws, or sockets. Open-end wrenches have fixed jaws at one or both ends of a handle which define a U-shaped wrench cavity for accepting the head of a fastener. These wrenches are primarily designed for use with hexagonal fastener heads but also may be used with any fastener head having an equal number of faces. To turn the fastener, the wrench is placed over the fastener with the flat jaws of the wrench aligned with flat surfaces on the head of the fastener, and force is exerted on the handle.

One problem experienced with conventional open-end wrenches is that the jaws often do not remain aligned with the flat surfaces when force is applied to the handle but rotate relative to the flat surfaces and contact the comers of the fastener head, thereby marring or rounding off the comers of the fastener. This relative rotation results in part from manufacturing tolerances inherent in the manufacture of wrenches and variances in the head sizes of the fasteners among manufacturers. Because of these variations, open-end wrenches are generally ineffective for turning fastener heads that are not hexagonal in shape or that have worn or rounded-off corners, especially if great force is required to turn the fastener.

Many attempts have been made to design an open-end wrench that reduces marring or rounding off of the corners of a fastener head and that can be used with marred fastener heads and non-hexagonal (particularly square) fastener heads. One example of an open-end wrench designed for this purpose is shown in U.S. Pat. No. 2,685,219 to Diebold. The wrench cavity shown by Diebold includes two curved bosses for contacting opposite flat surfaces of a fastener head. While providing some improvement over conventional open-end wrenches, this design suffers certain disadvantages in that it is not usable with fasteners having square heads due to its geometry. Likewise, the shape of the cavity tends to force a fastener away from the wrench when a large amount of torque is applied because of the position of its lower bosses.

Another drawback of Diebold is that the cavity exerts force primarily at the comers of a fastener head. For example, using the Diebold disclosure, a minimum free swing angle (in this case 21.0 degrees), median wrench and ¾ inch hex fastener tolerances, calculations show that Diebold engages the side of a fastener at a distance of 0.04 inches from the corner. (The median wrench opening tolerance is 0.759 inches and the median fastener tolerance for ¾ inch hex fastener is 0.743 inch. See ANSI B107.6.) The closer the point of contact on which force is exerted is to a comer of a fastener, the greater the chance for marring.

Another example of an open-end wrench designed to reduce rounding-off of the fastener comers is shown in U.S. Pat. No. 3,242,775 to Hinkle. While this design is intended to apply force to the flat faces or surfaces of a nut instead of the corners (Col. 2, lines 15–18), in actuality the disclosed wrench applies force at or close to the comers of the fastener (see FIGS. 8 & 12). For example, calculations made using the Hinkle disclosure, a minimum free-swing angle (in this case 3.5 degrees) and median wrench and fastener tolerances, show that Hinkle engages the side of a fastener at a distance of 0.07 inches from the comer.

It is also significant that Hinkle specifically teaches away from the use of a curved surface as the drive surface by claiming that such actually increases the indentation of the fastener. See col. 9, lines 71–75 and col. 10, lines 1–8. Use of such curved contact surfaces to reduce marring, however, is known in the industry. Examples of curved contact surfaces include U.S. Pat. No. 4,930,378 to Colvin, though this patent only discloses closed wrench applications. Even if one were to assume an open wrench design, however, calculations done using the disclosure in Colvin, a minimum free-swing angle (in this case 4.0 degrees) and median wrench and fastener tolerances show that Colvin would engage a fastener only 0.09 inches from a comer.

Colvin is also limited in the amount of torque it can apply to a fastener due to the presence of intersecting flat and arched surfaces that tend to create stress risers in that the point of intersection tends to take most of the load. While others have attempted to eliminate this stress riser problem by using continuously curved surfaces, for example U.S. Pat. No. 4,581,957 to Dossier, no improvement has been made in contacting the side of a fastener closer to the center. For example, using the Dossier disclosure, a median free-swing angle (in this case 4.0 degrees) and median wrench opening tolerances and fastener tolerances, and assuming an open wrench application, calculations still show a maximum point of contact at 0.09 inches from the comer of a fastener.

Therefore, despite the various efforts found in the prior art, there remains a need for an improved open-end wrench which can be used to turn a variety of fastener head configurations without marring.

SUMMARY OF THE INVENTION

The present invention advances the art by providing an improved open-end wrench that can be utilized with a variety of fastener head shapes and that reduces marring of the corners of the fastener head. The wrench has a handle for turning a fastener head having a pair of opposed contact surfaces positioned a distance A apart. The wrench comprises lower and upper jaws defining a wrench cavity for receiving a fastener head, a first clearance surface positioned at the rear end of the wrench cavity, an upper drive surface formed on the upper jaw and a lower drive surface formed on the lower jaw. The upper drive surface and the lower drive surface are offset from one another in a direction along an axis W that bisects the wrench cavity.

According to the preferred embodiment, the wrench cavity has a first concave clearance surface positioned adjacent to a web area opposite the handle and a pair of offset convex direct drive surfaces positioned adjacent to the first concave clearance surface. For a fastener having contact surfaces positioned a distance A apart, each convex drive surface of the wrench preferably has a radius of curvature R equal to A/2 and located adjacent to the point at which each drive surface contacts a corresponding contact surface of a fastener head. The centers of curvature C at the ends of the radii are offset from one another in a direction parallel to axis W bisecting the wrench cavity. The wrench cavity has a center reference point X which is defined by the intersection of the handle axis H and wrench cavity axis W. It is typical in the industry for the wrench cavity to be offset 15 degrees from an axis that runs through the center of the handle for ease of access to a fastener. The center of curvature $C_1$ of the top convex drive surface is located a distance S from a line P which is perpendicular to the wrench cavity axis W and intersects the center reference point X. The center of curvature $C_2$ of the lower drive surface is located a distance about 1.5 S from line P.

The offset drive surfaces ensure that the wrench contacts and captures the fastener at a point closer to the center of the flat as compared to the prior art. For example, calculations made with the disclosed preferred embodiment of the subject invention, a minimum free swing angle (in this case 6.0 degrees as disclosed below) and median wrench and fastener tolerances show that the wrench will engage the side of a fastener at a distance of at least 0.14 inches from the corner. As described above, the farthest contact point from the corner disclosed in the prior art, using the same calculations and assumptions, was 0.9 inches by Dossier and Colvin.

The subject invention also is able to apply force in a direction more tangentially than the prior art without rounding the corners of the fastener, thereby increasing the amount of force that can be applied to a fastener. By offsetting the drive surfaces, the direction of force applied by the wrench opening is changed such that it remains focused on the drive surfaces. Further, the use of a continuously curving transition between the offset drive surfaces and the clearance surfaces also permits increased force to be applied because it avoids the problems, as described above, resulting from the presence of intersecting flat and arched surfaces which tend to create stress risers because the point of intersection tends to take most of the load. The absence of such surfaces eliminates the stress riser concentration.

Thus, it is an object of the present invention to provide an improved open-end wrench.

It is a further object to provide an open-end wrench that reduces marring or rounding-off of the comers of a fastener head.

It is a further object of the present invention to provide an open-end wrench that can be used to turn various fastener head configurations and that can be used to drive worn fastener heads.

A further object of the present invention is to provide an improved end wrench that exerts force on the flat surfaces of a fastener head instead of the corners.

A still further object of the present invention is to provide an improved wrench with offset drive surfaces such that the wrench makes contact with a fastener at a point closer to the center of the flat and optimizes the direction of the force being exerted on the fastener and on the wrench opening.

Other objects, features, and advantages of the present invention will become apparent upon reading the following specification, when taken in conjunction with the drawings and the appended claims,

DETAILED DESCRIPTION OF THE PREFERRED EMBODIMENT

Figure 1:
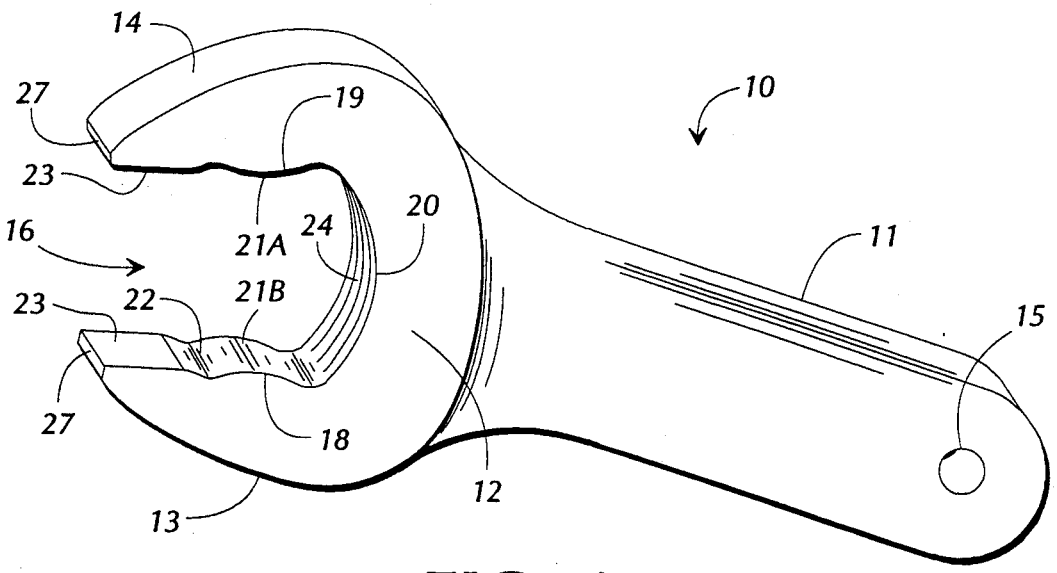
FIG. 1 is a perspective view of a preferred embodiment of the wrench of the present invention.

Referring now to the drawings, in which like numbers indicate like elements throughout the several views, FIG. 1 shows an open-end wrench 10 of one-piece forged steel construction. The wrench 10 comprises an elongate handle 11, a web area 12, and a pair of jaws 13 and 14. The handle 11 is shaped for grasping by the hand and is of conventional configuration. The web area 12 is of generally crescent shape and is formed at one end of the handle 11. A hole 15 is provided at the opposite end of the handle for hanging of the wrench 10 when not in use, and this opposite end is rounded for comfort. The jaws 13 and 14 extend from the web area 12 away from the handle 11 and are spaced apart to define a wrench cavity 16 there between for receiving a fastener head 17 (FIG. 2) of a nut, bolt, or other fastener. The jaws 13 and 14 are preferably offset at an angle to the handle 11 for more versatility when the fastener head 17 is hard to access.

The wrench cavity 16 has three sides 18, 19, and 20. The sides 18 and 19 are formed by mutually facing surfaces of the jaws 13 and 14, respectively. The side 20 is formed by the surface of the web area 12 opposite the handle 11 which is generally perpendicular to each of the sides 18 and 19. The sides 18 and 19 are mirror images of one another and each includes an offset convex drive surface, upper convex drive surface 21A and lower convex drive surface 21B, a concave clearance surface 22, and a flat guide surface 23. The side 20 provides a concave clearance surface 24. (It is understood that the terms "concave" and "convex" refer to the direction of curvature of the surfaces 21A, 21B, 22 and 24 relative to the wrench cavity 16 and the terms "upper" drive surface 21A and "lower" drive surface 21B are used for ease of illustration rather than as a spatial requirement.)

Figure 2:
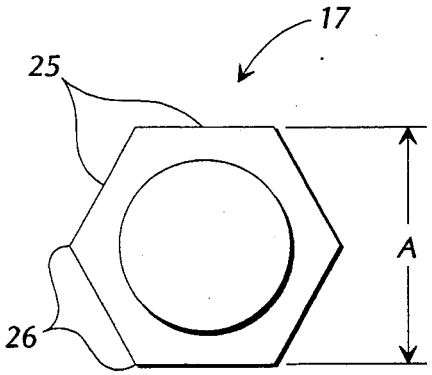
FIG. 2 is a plan view of a fastener head of a general type for which the wrench of the present invention is intended for use.

Referring now to FIG. 2, the fastener head 17 is generally hexagonal in shape. The fastener head 17 comprises a plurality of opposed flat surfaces 25 that intersect at comers 26. The flat surfaces 25 of the fastener head 17 are spaced apart by a distance or width A. The fastener head 17 may comprise the head of a bolt, in which case the fastener head will be located at one end of an elongated threaded shaft. Alternatively, the fastener head 17 may comprise a nut, in which case the fastener head will further comprise a threaded central bore. As used herein, it will be understood that the term "fastener head" will encompass both of these structures.

Figure 3:
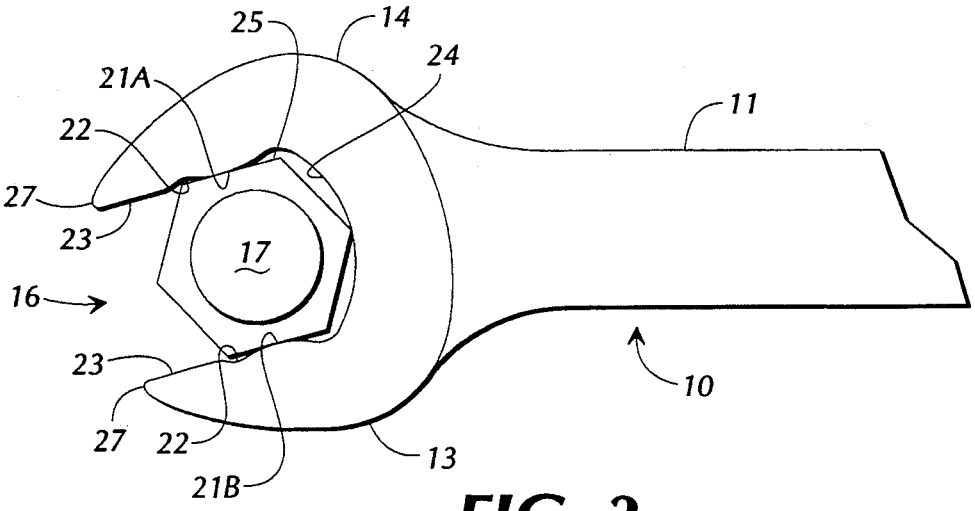
FIG. 3 is a plan view of the wrench of FIG. 1 positioned about the fastener of FIG. 2.

FIG. 3 shows the jaws 13, 14 of the wrench 10 placed around a fastener head 17, prior to the application of a force on the handle 11 to turn the fastener. The upper drive surface 21 A and the lower drive surface 21B of the wrench jaws 13, 14 are positioned to contact the sides of opposite flat surfaces 25 of the fastener head 17 when the fastener head is received within the wrench cavity 16, thereby to transmit force for turning the fastener. The upper drive surfaces 21A and the lower drive surface 21B are offset from one another so as to ensure that wrench 10 contacts the sides of opposing flat surfaces 25 as far as possible from the corners of the fastener head 17. The guide surfaces 23 are used to guide the wrench cavity toward the fastener head 17 and include angled surfaces 27 to further aid in guiding the wrench onto the fastener head. The clearance surfaces 22 and 24 provide clearance space between the fastener head and the wrench cavity.

Figure 4:
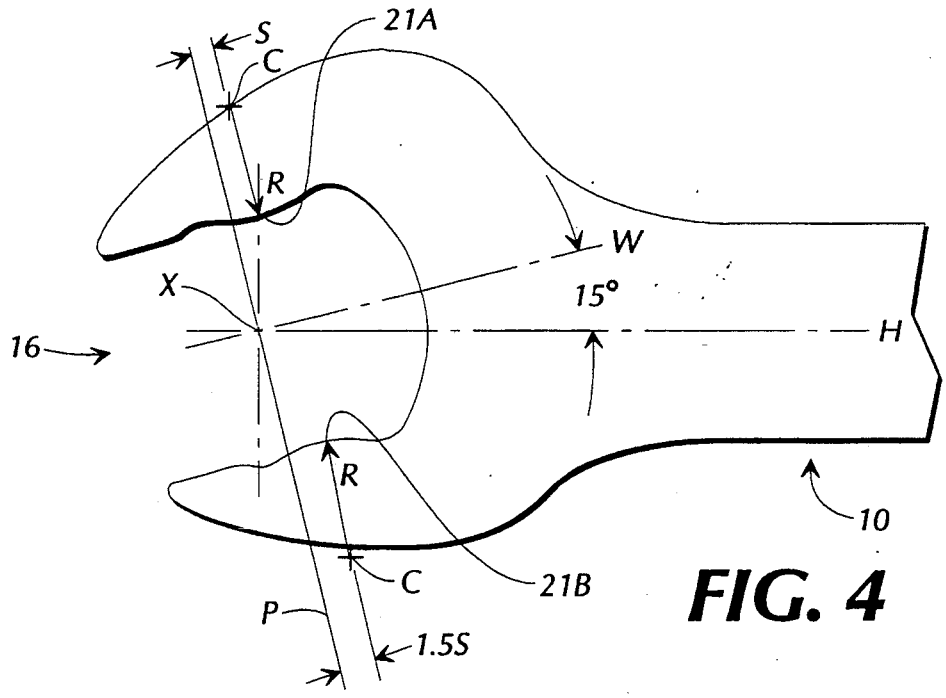
FIG. 4 is a side view of the wrench of FIG. 1.

The nature of the offset of upper drive surface 21A and lower drive surface 21B is shown in FIG. 4. The offset is defined with respect to axis W which bisects the wrench cavity 16. Both the upper drive surface 21A and the lower drive surface 21B have a radius of curvature R adjacent to the point at which they contact one of the corresponding contact surfaces 25 of a fastener head. Both the upper drive surface 21A and the lower drive surface 21B have a radius of curvature R equal to A/2. The centers of curvature $C_1$ and $C_2$ at the ends of the radii are offset from one another in a direction along this cavity axis W.

The wrench cavity 16 has a center reference point X which is determined by the intersection of cavity axis W and an axis H running through the center of handle 11. The center of curvature $C_1$ of the upper drive surface 21A is a distance S from line P which is perpendicular to the wrench cavity axis W (or 105 degrees off of the handle 11) and which intersects the center reference point X of wrench cavity 16. The center of curvature $C_2$ of the lower drive surface 21B is a distance about 1.5 S from line P. In the preferred embodiment, the center of curvature $C_1$ of the upper drive surface 21A is about 0.0712 inches from line P and the center of curvature $C_2$ of the lower drive axis is about 0.1072 inches from line P.

Figure 5:
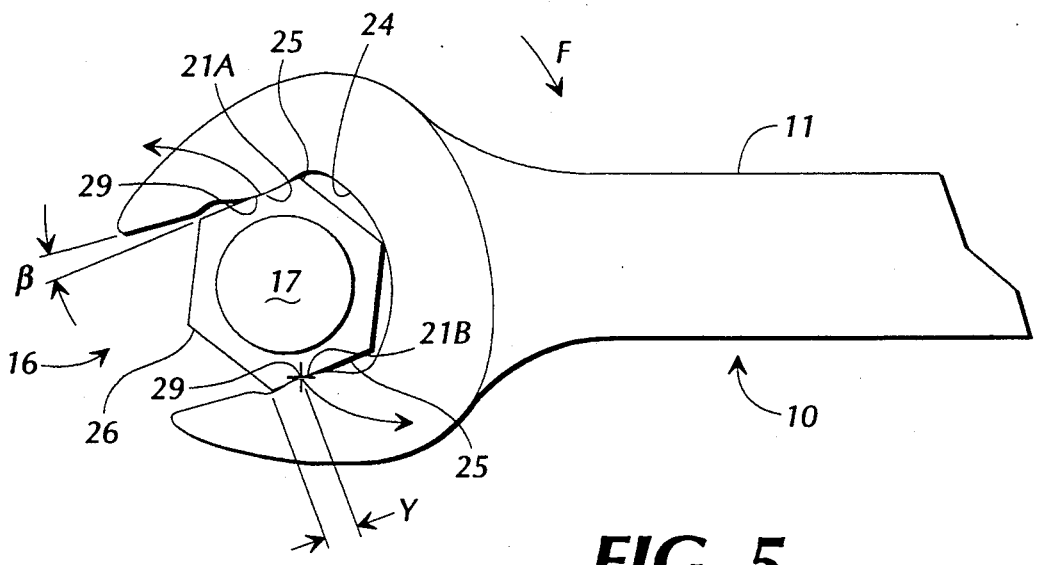
FIG. 5 is a plan view of the wrench of FIG. 1 when force is applied to the wrench handle to turn the fastener of FIG. 2.

In FIG. 5 there is shown the wrench cavity 16 as it is positioned relative to the fastener head 17 when a rotational force F is applied to the wrench handle 11 to turn the fastener in a clockwise direction. By offsetting upper drive surfaces 21A and lower drive surface 21B, the direction of the force applied by wrench 10 remains focused on the drive surfaces 21A and 21B such that increased torque may be applied when driving fastener head 17.

Upper drive surface 21A and lower drive surface 21B each contact one of the flat surfaces 25 at a point of contact 29. Because the wrench cavity rotates slightly relative to the fastener head upon the application of the rotational force F, each point of contact 29 is shifted slightly farther away from the midpoint of the flat surfaces 25, but remains located on the flat surface 25 of the fastener head. Thus, it will be appreciated that upper drive surfaces 21A and lower drive surface 21B do not contact any of the corners 26. In the preferred embodiment, contact point 29 is at least 0.1 inches from a corner of a fastener side. In addition, the clearance surfaces 22 and 24 provide sufficient clearance such that contact between the comers 26 and the clearance surfaces of the wrench cavity 16 is minimized when rotational force is applied to turn the fastener.

As discussed above, both the upper drive surface 21A and the lower drive surface 21B are each configured to have a radius of curvature R of a dimension equal to one-half of the width A of the fastener head. In addition, the axis of both upper drive surface 21A and lower drive surface 21B are spaced apart at a distance which distance exceeds the width A of the fastener head just enough to allow the fastener head 17 to be received with the cavity 16. This configuration provides a free-swing (the amount the wrench cavity rotates relative to the fastener head when force is applied to turn the fastener) of no more than about 6 degrees between both the upper drive surface 21A and the lower drive surface 21B and each contacted flat surface 25 at the point of contact 29. The free-swing is represented by an angle $\beta$ measured between the contacted flat surface 25 and a tangent 31 taken at each point of contact 29 (shown in FIG. 5). The low free-swing and the placement of the drive surfaces 21A and B reduce rotation of the wrench cavity 16 relative to the fastener head 17 when rotational force is applied to the handle 11 to turn the fastener. Because of this reduced relative rotation, the upper drive surface 21A and lower drive surface 21B of the wrench 10 are not permitted to contact the corners 26 of the fastener head 17 but instead remain in contact with the flat surfaces 25 of the fastener head.

Because the unique configuration of the wrench cavity 16 of the wrench 10 of the present invention transmits torque to the flat surfaces 25 of the fastener head 17 such that little or no contact between the comers 26 and the wrench cavity occurs, marring of the fastener head and "rounding" of the fastener head corners is reduced. Because the upper drive surface 21A and lower drive surface 21B of the wrench 10 contact only the flat surfaces 25 of the fastener head 17, the wrench of the present invention may be used to turn marred or "rounded off" fastener heads and to turn fastener heads having configurations other than hexagonal. The novel wrench cavity 16 also allows more torque to be applied to the fastener head 17 with less chance of marring, which is especially beneficial when working with fasteners made of softer materials, plated fasteners, or cosmetical fasteners. Finally, it will be understood that the preferred embodiment has been disclosed by way of example, and that other modifications may occur to those skilled in the art without departing from the scope and spirit of the appended claims.

I claim:

1. An open-end wrench, comprising:

(a) a handle;

(b) a web area positioned adjacent to said handle;

(c) lower and upper jaws extending from opposite sides of said web to define a wrench cavity for accepting a fastener head having contact surfaces positioned a distance "A" apart, said wrench cavity comprising:

(i) a first concave clearance surface positioned adjacent said web area opposite said handle; and (ii) a center reference point defined by the intersection of an axis running through the center of said handle and an axis bisecting said wrench cavity;

(d) an upper convex drive surface formed on said upper jaw having a radius of curvature R equal to A/2 and with a center of curvature $C_1$ located a distance S from a line P that is perpendicular to said cavity bisecting axis and which intersects said center reference point of said wrench cavity; and (e) a lower convex drive surface formed on said lower jaw having a radius of curvature R equal to A/2 and with a center of curvature $C_2$ located a distance about 1.5 S from said line P.

2. The wrench of claim 1 wherein both said upper convex drive surface and said lower convex drive surface each contact a corresponding one of said contact surfaces of said fastener head at a distance Y from a corner rather than said corner of said fastener head.

3. The wrench of claim 2 wherein said upper convex drive surface and said lower convex drive surface are in continuously curving contact with said first concave clearance surface.

4. The wrench of claim 2, further comprising a pair of second concave clearance surfaces positioned adjacent to said upper convex drive surface and said lower convex drive surface.

5. The wrench of claim 2 wherein when said wrench is acted upon by an external force to turn said fastener head, both said upper drive surface and said lower drive surface each contact a corresponding one of said contact surfaces of said fastener head at a point of contact such that tangents taken at each said point of contact form angles with the corresponding contact surfaces of no more than about 6 degrees.

6. The wrench of claim 2 wherein said center of curvature $C_1$ of said upper convex drive surface is about 0.071 inches from said line P and said center of curvature $C_2$ of said lower convex drive surface is about 0.107 inches from said line P.

7. The wrench of claim 2 wherein said lower convex drive surface engages the side of standard $\frac{3}{4}$ inch hexagon fastener at least 0.1 inch from the nearest corner of said fastener when force is applied to said handle.

8. A wrench with a handle for turning a fastener head having a pair of opposed contact surfaces positioned a distance A apart, said wrench comprising:

lower and upper jaws defining a wrench cavity therebetween for receiving said fastener head;

a first clearance surface positioned at a rear end of said wrench cavity;

said wrench cavity having an axis W bisecting said wrench cavity, a center reference point X defined by the intersection of said cavity bisecting axis W and a handle axis H running through the center of said handle, and a line P perpendicular to said cavity bisecting axis W and drawn through said center reference point X;

a convex upper drive surface formed on said upper jaw and a convex lower drive surface formed on said lower jaw;

said upper drive surface and said lower drive surface each having a radius of curvature R equal to A/2 adjacent to the point at which they each contact one of said contact surfaces of said fastener head;

said radius of curvature R on said upper drive surface having a center of curvature $C_1$ and said radius of curvature R on said lower drive surface having a center of curvature $C_2$;

said center of curvature $C_1$ and said center of curvature $C_2$ being offset from one another along said cavity bisecting axis W such that the distance of said center of curvature $C_2$ from said perpendicular line P is about 1.5 times the distance of said center of curvature $C_1$ from said perpendicular line P.

9. The cavity of claim 8 wherein when said fastener head is accepted within said cavity, both said upper drive surface and said lower drive surface each contact a corresponding one of said contact surfaces of said fastener head at a distance Y from a corner rather than contacting said corner of said fastener head.

10. The wrench of claim 8 wherein the distance of said center of curvature $C_1$ of said upper drive surface is about 0.071 inches from said line P and said center of curvature $C_2$ of said lower drive surface is about 0.107 inches from said line P.

11. The wrench of claim 8, wherein said lower drive surface engages the side of a standard $\frac{3}{4}$ inch hexagon fastener at least 0.1 inch from the nearest corner of said fastener when force is applied to said handle.

12. The wrench of claim 8 wherein when said wrench is acted upon by an external force to turn said fastener head, both said upper drive surface and said lower drive surface each contact a corresponding one of said contact surfaces of said fastener head at a point of contact such that tangents taken at each said point of contact form angles with the corresponding contact surfaces of no more than about 6 degrees.

* * * * *